US005996992A

United States Patent [19]

Raschke et al.

[11] Patent Number: 5,996,992

[45] Date of Patent: Dec. 7, 1999

[54] TRANSFER DEVICE

[75] Inventors: Josef Raschke, Pliening; Rudolf Schuster, Kirchheim, both of Germany

[73] Assignee: Siemens Aktiengesellschaft, Munich, Germany

[21] Appl. No.: 08/952,022

[22] PCT Filed: May 3, 1996

[86] PCT No.: PCT/DE96/00780

§ 371 Date: Nov. 3, 1997

§ 102(e) Date: Nov. 3, 1997

[87] PCT Pub. No.: WO96/34703

PCT Pub. Date: Nov. 7, 1996

[30] Foreign Application Priority Data

May 5, 1995 [DE] Germany ..... 195 16 666

[51] Int. Cl.[6] ..... B65H 29/40

[52] U.S. Cl. ..... 271/200; 198/463.2

[58] Field of Search ..... 271/200, 201; 198/463.2; 209/900

[56] References Cited

U.S. PATENT DOCUMENTS 2,940,580 6/1960 FRANCOIS ..... 198/463.2
5,104,105 4/1992 Coute et al. ..... 271/200

*Primary Examiner*—William E. Terrell
*Assistant Examiner*—Mark Deuble
*Attorney, Agent, or Firm*—Hill & Simpson

[57] ABSTRACT

A transfer apparatus for transferring items from a first conveying device to moving assigned item carriers carried on a second conveying device is disclosed. The item carriers and the second conveying device move in a second transporting direction which is opposite to a first transporting direction of the first conveying device. The transfer apparatus includes a transfer member which includes a continuous circulating conveying belt and a continuous circulating pressure-exerting belt. The transfer member receives items from the first conveying device between the two belts and discharges them through a discharge region to the moving item carriers. The discharge region of the transfer member pivots along the second transporting direction of the item carriers. The transfer member is aligned with the second conveying device so that items are discharged through the discharge region to the assigned item carriers without movement of the discharge region in a direction which would be out of alignment with the second transporting direction.

14 Claims, 1 Drawing Sheet

TRANSFER DEVICE

BACKGROUND OF THE INVENTION

1. Field of the Invention

The present invention is directed generally to transfer devices for transferring small items, such as mailpieces from one conveying mechanism to another. Still more specifically, the present invention is directed towards a transfer device for transferring small items delivered by one conveying device to assigned item carriers transported by a second conveying device.

2. Description of the Prior Art

The machine-readable postcodes or postal codes that are currently being printed on items of mail, such as letters, postcards, packets and the like, serve as an identification for a location, a postal district, a PO box or a major recipient. These postal codes permit rapid, mechanical distribution of mail. Sorting of the incoming items of mail takes place, for example, with the aid of controllable mailpiece carriers which are each loaded with an item of mail in special loading locations. The mailpieces are then discharged to a sorting container, or a corresponding sorting compartment, assigned to the respective postcode. Since the sorting containers or sorting compartments may be arranged in various levels, the item carriers circulating on conveying devices must, if appropriate, also be capable of spanning various levels. After transfer of the item of mail to the assigned sorting container or the assigned sorting compartment, the empty item carriers can then once again be loaded with an item of mail when they pass a loading location, as disclosed in DE-A-43 23 564. When the mail is transferred to the above described sorting apparatus, the items of mail arriving on a first conveying device, e.g. a belt conveyor, must be discharged in a specific manner and, preferably, individually to the item carriers, which pass at relatively high speed.

SUMMARY OF THE INVENTION

The present invention provides improved transfer apparatus for transferring items from a first conveying device to assigned item carriers that are moving and being carried on a second conveying device. The first conveying device may be moving in a direction that is opposite or at least different from the direction in which the item carriers and second conveying device are moving. The transfer apparatus of the present invention includes a transfer member which comprises two circulating belts—a conveying belt and a pressure-exerting belt. The transfer member receives the items to be transferred from the first conveying device and between the conveying belt and pressure-exerting belt. The moving belts then discharge the items through a discharge region of the transfer member to the moving item carriers. The discharge region of the transfer member pivots along the transporting direction of the item carriers during the discharge process so that the items being transferred are traveling in the transporting direction of the item carriers and second conveying device when they are being discharged. The transfer member is also aligned with the second conveying device such that the items are discharged through the discharge region to the assigned item carriers without movement of the discharge region in a direction that is transverse to the transporting direction.

In an embodiment, the discharge region of the transfer member pivots about a pivot pin which is aligned transversely to the transporting direction of the item carriers.

In an embodiment, the discharge region of the transfer member pivots about a pivot pin which is disposed vertically above and perpendicular to the transporting direction of the item carriers.

In an embodiment, the conveying belt and pressure exerting belt travel at a first velocity, and during the discharge of an item to the item carriers, the discharge region is pivoted along the transporting direction at a second velocity, and the second conveying device is traveling in the transporting direction at a third velocity. The first, second and third velocities each have horizontal components in the transporting direction. The horizontal components of the first and second velocities combined being approximately equal to the horizontal component of the third velocity. In other words, the discharged item is traveling in the transporting direction at about the same velocity as the item carriers and second conveying device.

In an embodiment, the first conveying device is traveling in a direction that is generally opposite to the transporting direction, or the direction in which the item carriers and second conveying device is moving.

In an embodiment, the first conveying device is disposed vertically above the second conveying device with the transfer member extending downward from the first conveying device to the second conveying device.

In an embodiment, the first conveying device is traveling in a first direction while the second conveying device and item carriers are traveling in a transporting direction that is generally opposite to the first direction. The discharge region of the transfer member pivoting along the transporting direction with a velocity having a horizontal component that is opposite to the horizontal component of the velocity of the first conveying device during the discharge of an item from the transfer member to an item carrier that is traveling on the second conveying device.

In an embodiment, the present invention provides a method of transferring a plurality of items being transported on a first conveying device traveling in a first direction and at a first velocity to moving assigned item carriers carried by a second conveying device traveling in a second transporting direction and at a second velocity. The method comprises the steps of providing a transfer member disposed above the item carriers and comprising a conveying belt and a pressure-exerting belt. A lower end roller of the conveying belt being disposed adjacent to a discharge region. The method includes the steps of receiving the items arriving at the transfer member on the first conveying device between the conveying belt and pressure-exerting belt, pivoting the discharge region of the transfer member downward and along the transporting direction of the item carriers while discharging the items through the discharge region so that the items are moving in the transporting direction with a horizontal velocity component approximately equal to the second velocity when the items are discharged from the discharge region of the transfer member and preventing movement of the discharge region in a direction transverse to the transporting direction.

The present invention specified in claim 1 is based on the problem of providing a transfer device for mail which is of a simple construction and by means of which the mail arriving on a first conveying device can be discharged in a reliable and careful manner onto circulating item carriers of a sorting apparatus.

A transfer device according to the invention can be used in public post offices or central in-house mail departments of large organizations in order to transfer mail to circulating item carriers. Moreover, a transfer device according to the invention may also, however, be used for comparable tasks, for example, in storage systems or automated order-picking systems, in the case of which items, provided with codings, arriving on a first conveying device are to be transferred to item carriers of a second conveying device.

The invention is based on the finding that a transfer member comprising a conveying belt and associated pressure-exerting belt permits reliable and careful transfer, to circulating item carriers, of the items arriving on a first conveying device when the discharge region of the transfer member can be displaced in the transporting direction of the item carriers without a movement component in the transverse direction. As a result, the discharge speed and the discharge direction of the items are coordinated in optimum fashion with the speed and the receiving direction of the circulating item carriers.

An advantage of the present invention is that it provides, by way of a simple pivot movement, a particularly simple displacement of the discharge region of the transfer member in the transporting direction of the item carriers and back again.

An advantage of the present invention is that it permits particularly careful transfer of the items to the circulating item carriers.

BRIEF DESCRIPTION OF THE DRAWING

For a more complete understanding of the present invention, reference should now be made to the embodiment illustrated in greater detail and the accompanying drawing and described below by way of an example of the present invention.

In the drawing.

Figure 1:
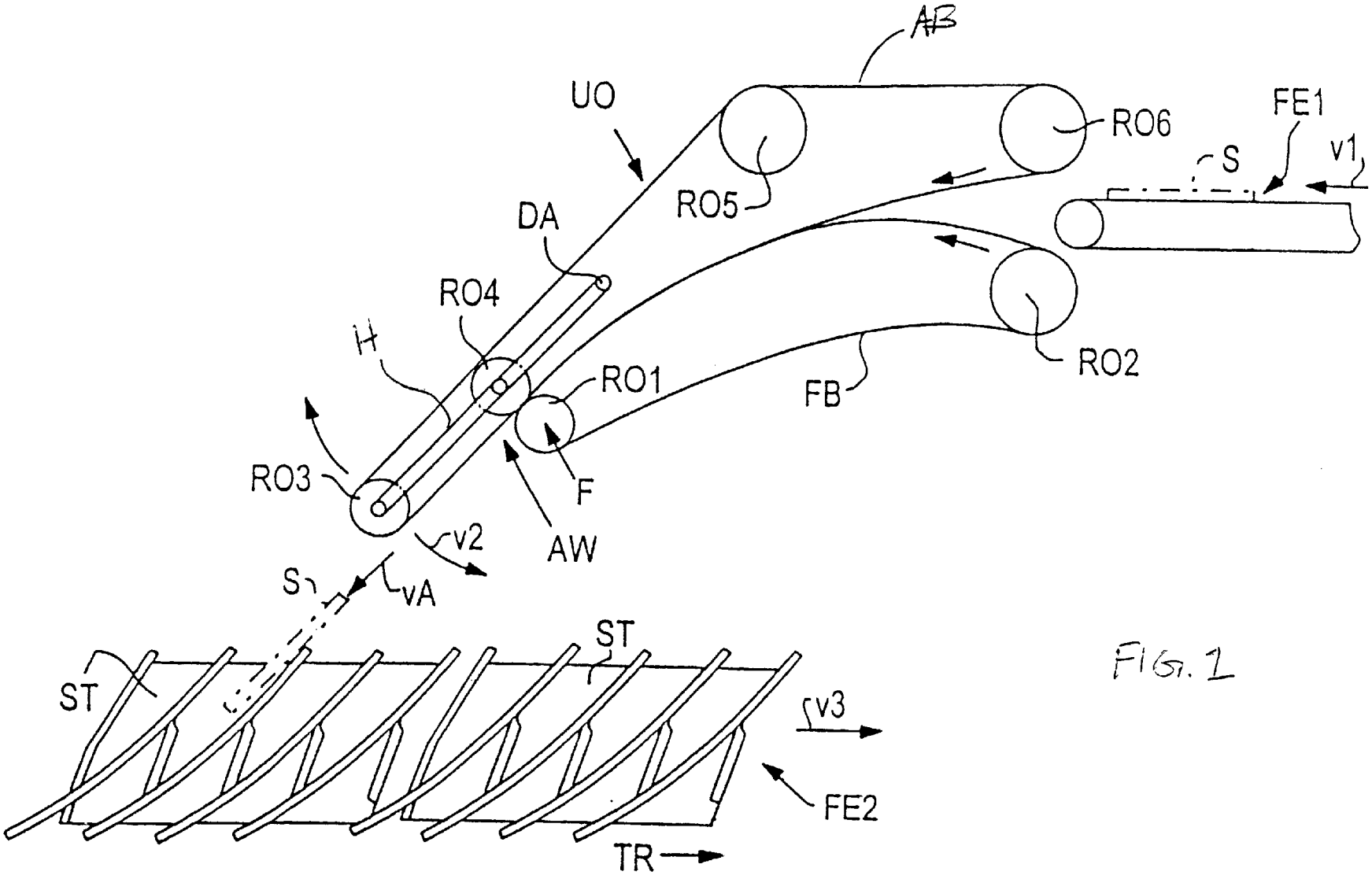
FIG. 1 is a schematic illustration of a transfer member for transferring items from a first conveying device to moving item carriers being carried by a second conveying device.

It should be understood that the drawing is not necessarily to scale and that the embodiment is illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENT

An exemplary embodiment of the invention is illustrated in the drawing and is described in more detail hereinbelow.

FIG. 1 is a simplified schematic illustration of a transfer device for items made in accordance with the present invention. This transfer device comprises a transfer member, which is designated as a whole by UO, receives, between an endlessly circulating conveying belt FB and an endlessly circulating pressure-exerting belt AB, the items S arriving on a first conveying device FE1 at the speed v1 and discharges these items to circulating item carriers ST of a second conveying device FE2.

The items S, shown in phanthom, are, for example, letters, which may have various formats and are separated at a location which is not illustrated any more specificity in the drawing and are fed onto the first conveying device FE1 from above.

The conveying belt FB is guided over a plurality of rollers, of which only the two end rollers RO1 and RO2 are illustrated in the drawing. The pressure-exerting belt AB is likewise guided over a plurality of rollers, of which two front rollers RO3 and RO4, a roller RO5 which serves as a deflection roller, and a rear, end roller RO6 are illustrated in the drawing. The two front rollers RO3 and RO4 are arranged rotatably on a lever H, it being possible for said lever H, for its part, to be pivoted about a pivot pin DA running perpendicularly with respect to the plane of the drawing. The front roller RO1 of the conveying belt FB is likewise mounted in a movable manner and is pressed, by the force of a spring, which is merely indicated by an arrow F, against the pressure-exerting belt AB, or the roller RO4. The described pivotable arrangement of the front regions of the conveying belt FB and pressure-exerting belt AB can pivot the discharge region of the transfer member UO, said discharge region being designated by AW, about the pivot pin DA. Upon discharge of the items S to an item carrier ST passing, at the speed v3, in the transporting direction TR, the discharge region AW can thus be pivoted by the speed v2, i.e. the horizontal component of the discharge speed vA of the items S can be coordinated, in magnitude and direction, to the speed v3 of the passing item carriers ST. This coordination and the avoidance of movement components of the discharge speed vA which run transversely with respect to the transporting direction TR, i.e. perpendicularly with respect to the plane of the drawing, ensure particularly reliable and careful transfer of the items S to the circulating item carriers ST.

The abovementioned item carriers ST of the second conveying device FE2 are components of a mail sorting apparatus, of which the construction and mode of operation is described, for example, in DE-A-43 23 564.

From the above description, it is apparent that the objects and advantages of the present invention have been achieved. While only certain embodiments have been set forth, alternative embodiments and various modifications will be apparent from the above description to those skilled in the art. These and other alternatives are considered equivalents and within the spirit and scope of the present invention.

We claim:

1. A transfer system comprising:

a transfer apparatus, a first conveying device and a second conveying device, the transfer apparatus for transferring items from the first conveying device moving in a first transporting direction to moving assigned item carriers carried on the second conveying device, the item carriers and second conveying device moving in a second transporting direction, the second transport direction extending through a plane, the transfer apparatus further comprising a transfer member comprising a continuous circulating conveying belt and a continuous circulating pressure-exerting belt, the transfer member receiving the items arriving on the first conveying device between the conveying belt and pressure-exerting belt and discharging the items through a discharge region to the moving item carriers, the discharge region of the transfer member pivoting along the first and second transporting directions, the transfer member being aligned with the second conveying device such that the items are discharged through the discharge region to assigned item carriers without movement of the discharge region in a direction transversely parallel to the plane of the second transporting direction, the first and second transporting directions being opposite to one another, the item carriers of the second conveying device each comprising front and rear panels extending through the plane of the second transporting direction and towards the second transporting direction and at an angle greater than 0° and less than 90°.

2. The transfer system of claim 1 wherein the discharge region of the transfer member is pivoted about a pivot pin which is perpendicular to the second transporting direction and parallel to the plane of the second transporting direction.

3. The transfer system of claim 1 wherein the discharge region of the transfer member is pivoted about a pivot pin which is disposed vertically above and perpendicular to the second transporting direction of the item carriers.

4. The transfer system of claim 1 wherein the conveying belt and pressure-exerting belt travel at a first velocity, during the discharge of an item to the item carriers, the discharge region is pivoted along the second transporting direction at a second velocity, the second conveying device traveling in the second transporting direction at a third velocity, the first, second and third velocities each having horizontal components in the plane of the second transporting direction, the combined horizontal components of the first and second velocities being approximately equal to the horizontal component of the third velocity.

5. The transfer system of claim 1 wherein the first conveying device is disposed vertically above the second conveying device and the transfer member is angled downward from the first conveying device towards the second conveying device.

6. The transfer system of claim 4 wherein the first conveying device is disposed vertically above the second conveying device, the transfer member is angled downward from the first conveying device towards the second conveying device.

7. A transfer system comprising:

a transfer apparatus, a first conveying device and a second conveying device, the transfer apparatus for transferring items from the first conveying device moving in a first transporting direction to moving assigned item carriers carried on the second conveying device, the item carriers and second conveying device moving in a second transporting direction, the first transporting direction being opposite to the second transporting direction, the second transport direction extending through a plane, the transfer apparatus comprising a transfer member disposed above the item carriers and comprising a continuous circulating conveying belt and a continuous circulating pressure-exerting belt, the transfer member receiving the items arriving on the first conveying device between the conveying belt and pressure-exerting belt and discharging the items through a discharge region to the moving item carriers, the discharge region of the transfer member pivoting downward and along the second transporting direction of the item carriers during discharge of the items so that the items are moving in the second transporting direction when they are discharged from the discharge region of the transfer member, the transfer member being aligned with the second conveying device such that the items are discharged through the discharge region to assigned item carriers without movement of the discharge region in a direction transversely parallel to the plane of the second transporting direction, and the item carriers of the second conveying device each comprising front and rear panels extending through the plane of the second transporting direction and towards the second transporting direction and at an angle greater than 0° and less than 90°.

8. The transfer system of claim 7 wherein the discharge region of the transfer member is pivoted about a pivot pin which is aligned parallel to the plane of the second transporting direction of the item carriers.

9. The transfer system of claim 7 wherein the discharge region of the transfer member is pivoted about a pivot pin which is disposed vertically above and perpendicular to the transporting direction of the item carriers.

10. The transfer system of claim 7 wherein the conveying belt and pressure-exerting belt travel at a first velocity, during the discharge of an item to the item carriers, the discharge region is pivoted along the second transporting direction at a second velocity, the second conveying device traveling at a third velocity, the first, second and third velocities each having horizontal components in the second transporting direction, the horizontal components of the first and second velocities being approximately equal to the horizontal component of the third velocity.

11. A method of transferring a plurality of items being transported on a first conveying device traveling in a first transporting direction at a first velocity to moving assigned item carriers carried by a second conveying device traveling in a second transporting direction and at a second velocity, the second transport direction extending through a plane, the first and second transporting directions being opposite to one another, the item carriers of the second conveying device each comprising front and rear panels extending through the plane of the second transporting direction and towards the second transporting direction and at an angle greater than 0° and less than 90°, the method comprising the following steps:

providing a transfer member disposed above the item carriers and comprising a continuous circulating conveying belt and a continuous circulating pressure-exerting belt, the conveying belt being wrapped around a plurality of rollers including a lower end roller, the lower end roller being disposed adjacent to a discharge region, receiving the items at the transfer member arriving on the first conveying device and moving in the first transporting direction between the conveying belt and pressure-exerting belt, pivoting the discharge region of the transfer member downward and along the second transporting direction of the item carriers while discharging the items through the discharge region so that the items are moving in the transporting direction with a horizontal velocity component in the second transporting direction approximately equal to the second velocity when the items are discharged from the discharge region of the transfer member, and preventing movement of the discharge region in a direction the second transporting direction.

12. The method of claim 11 wherein the pivoting step further comprises pivoting the discharge region about a pivot pin which is aligned parallel to the plane of the second transporting direction of the item carriers and perpendicular to the second transporting direction.

13. The method of claim 11 wherein the pivoting step further comprises pivoting the discharge region about a pivot pin which is aligned vertically above and perpendicular to the transporting direction of the item carriers.

14. The method of claim 11 wherein the conveying belt and pressure-exerting belt travel at a third velocity having a horizontal component, the horizontal components of the first and third velocities being approximately equal to the horizontal component of the second velocity.

* * * * *